US007958756B2

(12) United States Patent
Gracia Bobed

(10) Patent No.: US 7,958,756 B2
(45) Date of Patent: Jun. 14, 2011

(54) GASKET AND A WASHING MACHINE HAVING THE SAME

(75) Inventor: Ismael Gracia Bobed, Zaragoza (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 475 days.

(21) Appl. No.: 12/085,291

(22) PCT Filed: Nov. 29, 2006

(86) PCT No.: PCT/EP2006/069053

§ 371 (c)(1),
(2), (4) Date: May 20, 2008

(87) PCT Pub. No.: WO2007/063072

PCT Pub. Date: Jun. 7, 2007

(65) Prior Publication Data

US 2009/0165505 A1 Jul. 2, 2009

(30) Foreign Application Priority Data

Dec. 2, 2005 (ES) ..... 200503073

(51) Int. Cl.
*D06F 37/00* (2006.01)

(52) U.S. Cl. ..... 68/24; 68/139

(58) Field of Classification Search ..... 68/23.1, 68/24, 58, 139, 142, 196; 277/500
See application file for complete search history.

(56) References Cited

U.S. PATENT DOCUMENTS

| | | | | |
|---|---|---|---|---|
| 5,881,579 | A | 3/1999 | Ellingson | |
| 6,256,823 | B1 * | 7/2001 | Kronbetter et al. | 8/158 |
| 7,251,963 | B2 * | 8/2007 | Kim et al. | 68/196 |
| 2003/0061842 | A1 * | 4/2003 | Ryu et al. | 68/17 R |
| 2003/0121294 | A1 * | 7/2003 | Ryu et al. | 68/58 |
| 2004/0103693 | A1 | 6/2004 | Kim et al. | |
| 2004/0107742 | A1 * | 6/2004 | Kim et al. | 68/24 |
| 2004/0107743 | A1 * | 6/2004 | Kim et al. | 68/140 |
| 2004/0148978 | A1 | 8/2004 | Kim et al. | |
| 2004/0163426 | A1 | 8/2004 | Kim et al. | |
| 2005/0102766 | A1 * | 5/2005 | Vande Haar et al. | 8/159 |
| 2005/0178168 | A1 | 8/2005 | Kim et al. | |
| 2005/0178169 | A1 | 8/2005 | Kim et al. | |
| 2005/0178170 | A1 | 8/2005 | Kim et al. | |
| 2005/0262879 | A1 | 12/2005 | Kim et al. | |

(Continued)

FOREIGN PATENT DOCUMENTS

DE 37 38 388 5/1989

(Continued)

*Primary Examiner* — Joseph L Perrin
(74) *Attorney, Agent, or Firm* — James E. Howard; Andre Pallapies

(57) ABSTRACT

An improved gasket (1) for a drum-type washing machine comprises a front flange (11) and a rear flange (15). Between the front flange (11) and the rear flange (15), a first substantially U-shaped section (13) connects to the front flange (11) and a second section (14) connects said first section (13) and the rear flange (15), wherein said second section (14) has a substantially flat contour at a lower position and increasingly curves outwardly from the axis from the lower position to a lateral position while decreasingly curves outwardly from the axis from the lateral position to an upper position opposite to said lower position. In such a configuration, said gasket (1) can absorb the greater vibration occurred in the lateral position in a normal washing operation process.

14 Claims, 4 Drawing Sheets

U.S. PATENT DOCUMENTS

| | | | | |
|---|---|---|---|---|
| 2006/0174663 | A1 * | 8/2006 | Cimetta et al. | 68/3 R |
| 2006/0218975 | A1 | 10/2006 | Graute et al. | |

FOREIGN PATENT DOCUMENTS

| | | |
|---|---|---|
| DE | 198 56 973 | 6/1999 |
| EP | 1 067 231 | 1/2001 |
| EP | 1 522 623 | 4/2005 |
| ES | 2 276 625 | 3/2007 |
| GB | 2 023 186 | 12/1979 |
| GB | 2 114 606 | 8/1983 |
| GB | 2 296 018 | 6/1996 |
| WO | WO 02/22936 | 3/2002 |
| WO | PCT/EP2006/069053 | 3/2007 |

* cited by examiner

GASKET AND A WASHING MACHINE HAVING THE SAME

BACKGROUND OF THE INVENTION

1. Field of the Invention

The present invention relates to a gasket and to a washing machine having the same, and more particularly to a drum-type washing machine having such gasket.

2. Description of Prior Art

In a known drum-type washing machine, a frame forms an exterior of the washing machine and has a front opening for loading and retrieving laundry via a door. A tub is suspended inside of the frame to hold water and detergent used for cleaning laundry. Inside of the tub, a drum installed to accommodate the laundry mixed with the water and detergent rotates with respect to an axis of rotation when driven by a driver in a normal operation process (e.g. a washing or rinsing operation process). To prevent the water from entering into and the laundry from becoming stuck or wedged at a space between the tub and the frame and attenuate the vibration caused by the high speed rotation of the drum and tub assembly when in operation, an annular shaped gasket is employed between the tub and the frame as disclosed in US 2005/0178169 A1. The gasket includes a shock absorber having an annular shape corresponding to that of the gasket, in which a bent portion is formed by shaping an excess length of the gasket material into a U-shaped bend. However, this U-shaped bend, especially on its lateral sections as detected, inclines to break due to the unequal vibration in the perimeter of the gasket in a long run.

Therefore such gasket needs to be improved to overcome the above-mentioned disadvantages.

SUMMARY OF THE INVENTION

Accordingly, an objective of the present invention is to provide an improved gasket for a washing machine that provides different shock-absorbing capacity in the perimeter of the gasket according to different vibration transferred by the drum and the tub assembly in a normal operation process.

According to the present invention, the above-mentioned objective is achieved by an improved gasket coupled between a frame of a washing machine and a tub disposed inside the frame, and a drum defining an axis of rotation is installed within said tub. Said gasket comprises a front flange connected to the frame and a rear flange connected to the tub and engaged with the drum. Between the front flange and the rear flange, a first mainly U-shaped section connects to the front flange and a second section connects said first section and the rear flange. Furthermore, said second section has a substantially flat contour at a lower position below said axis and increasingly curves outwardly from the axis from the lower position to a lateral position while it decreasingly curves outwardly from the axis from the lateral position to an upper position opposite to said lower position. In such a configuration, said gasket can absorb the greater vibration occurred in the lateral position.

According to other features of the present invention, a first curved brim extends outwardly from the front flange to engage with a first curved rim of the frame, and a second curved brim extends outwardly from the rear flange to engage with a second curved rim of the tub. Furthermore a groove extends inwardly from the rear flange to engage with a bent edge of said drum to prevent the laundry from entering into the space between the drum and the tub. Preferably one protrusion having a bent end towards an inside of the drum extends inwardly from said groove at an apex position above said axis. At a lower position opposite to said apex position, a plurality of water leakages are disposed in said rear flange to return the residual water back into the tub. To additionally increase the rigidity of the gasket, a plurality of ribs are disposed on a perimeter of said first section at a position near to said front flange.

Other objects, advantages and novel features of the invention will become apparent from the following detailed description of preferred embodiment when taken in conjunction with the accompanying drawings.

DETAILED DESCRIPTION OF THE PREFERRED EMBODIMENT

Figure 1:
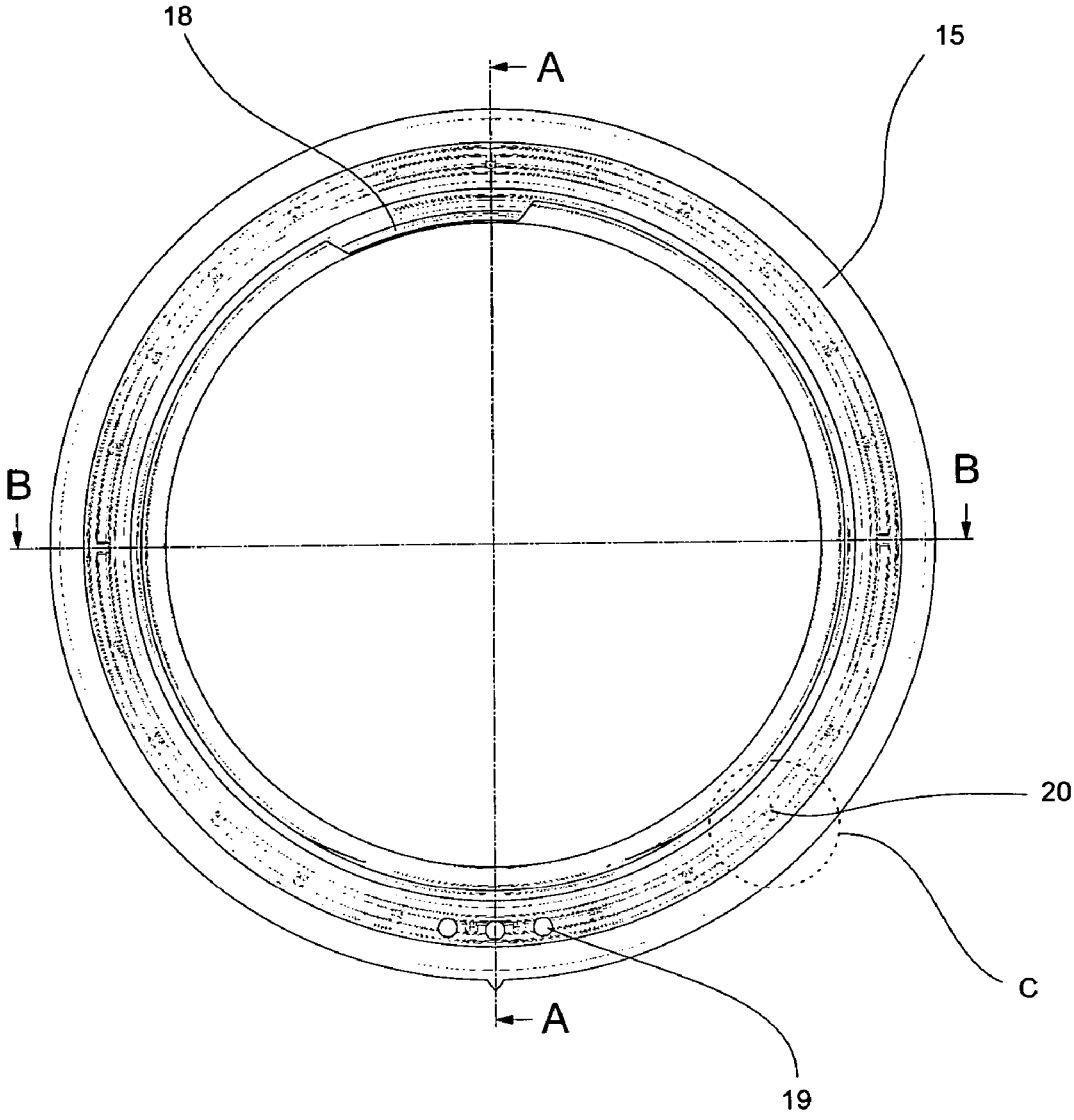
FIG. 1 is a perspective view of a gasket.
Figure 2:
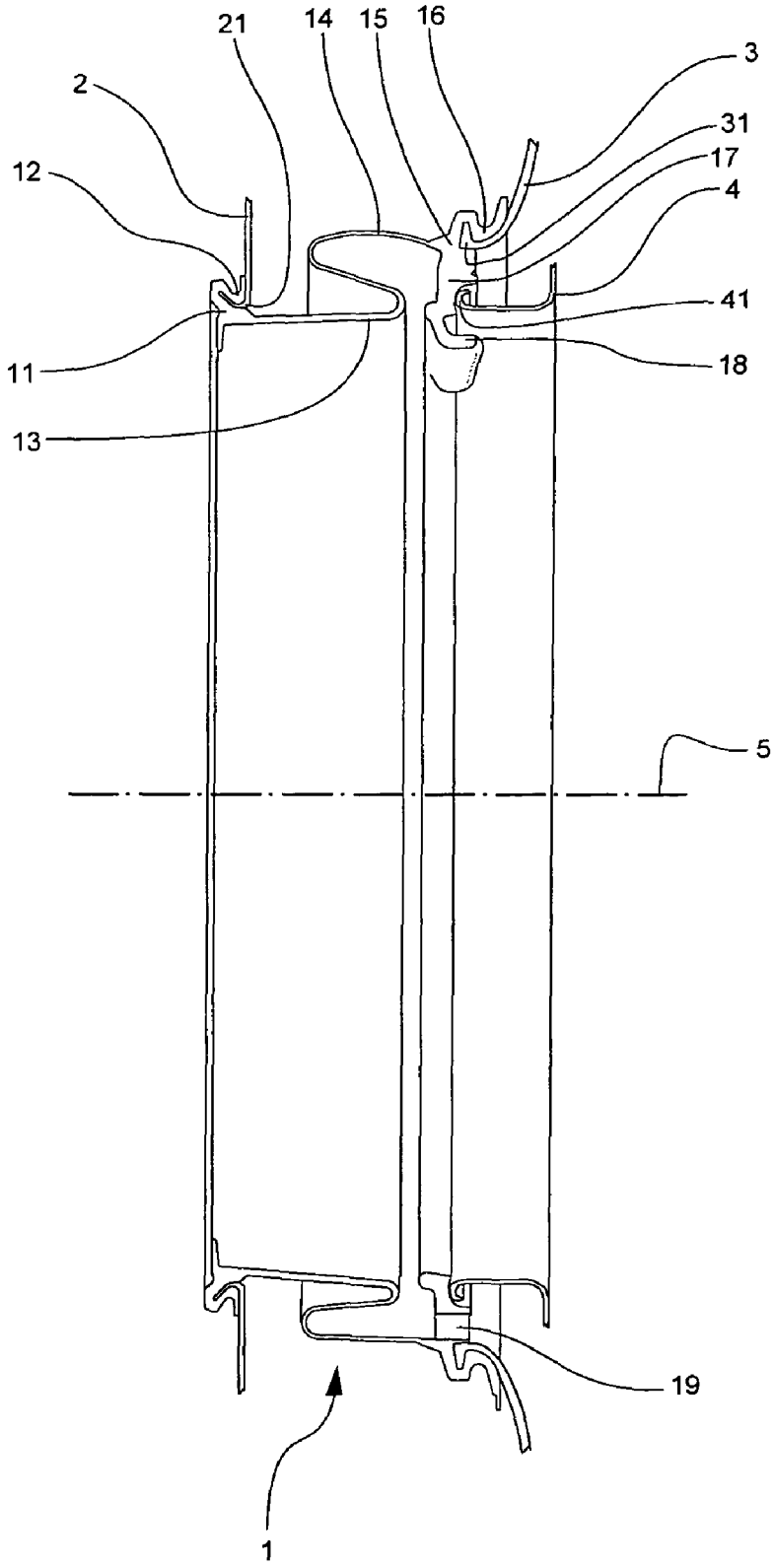
FIG. 2 is a cross-sectional view of the gasket assembled with a frame, a tub and a drum in a washing machine when taken along line A-A.
Figure 3:
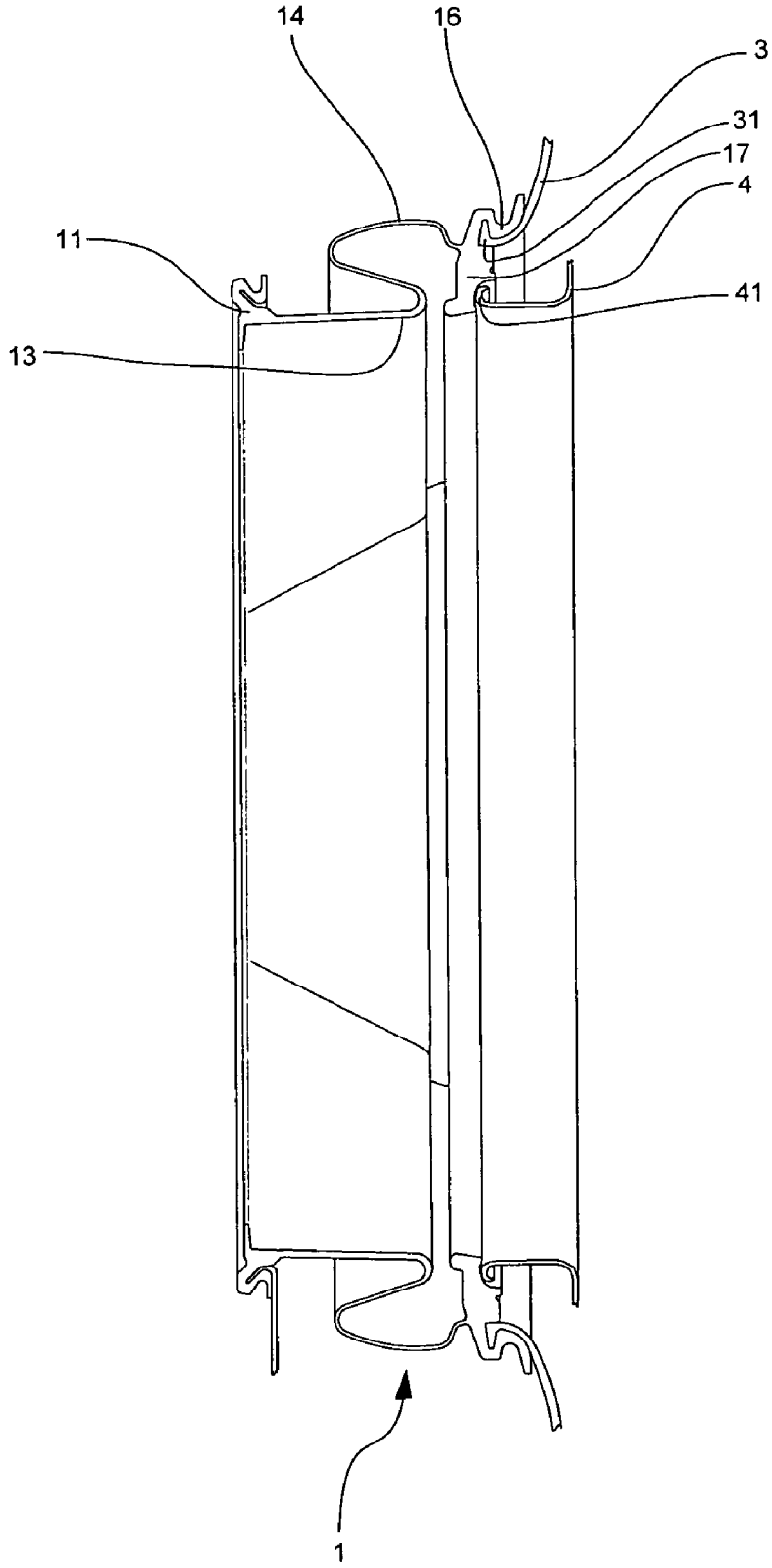
FIG. 3 is a cross-sectional view of the gasket taken along line B-B.

An improved gasket 1 as shown in FIGS. 1 to 3 is used for a drum-type washing machine (not shown). Said washing machine comprises a frame 2 forming an exterior of the washing machine and a tub 3 suspended inside the frame 2 for holding water. A drum 4, which is installed inside the tub 3, is rotated on an axis 5 inside the tub 3 when driven by a driver to perform a washing, rinsing or drying process in a normal operation. As shown in FIG. 2, said gasket 1 interposed between the frame 2 and the tub 3 comprises a front flange 11 and a rear flange 15. Preferably said front flange 11 further includes a first curved brim 12 extending outwardly and engaging with a first curved rim 21 of the frame 2 to retain the front flange 11 onto the frame 2. Meanwhile, said rear flange 15 further includes a second curved brim 16 extending outwardly and engaging with a second curved rim 31 of the tub 3 and a groove 17 extending inwardly from the rear flange 15 to engage with a bent edge 41 of said drum 4 to prevent the laundry from entering into the space between the drum 4 and the tub 3. Between the front flange 11 and the rear flange 15, a first substantially U-shaped section 13 connects to the front flange 11 and a second section 14 connects said first section 13 and the rear flange 15, wherein said second section 14 has a substantially flat contour at a lower position below said axis 5 and increasingly curves outwardly from the lower position to a lateral position while decreasingly curves outwardly from the lateral position to an upper position opposite to said lower position. In such a configuration, said gasket 1 can absorb the greater vibration occurred in the lateral position.

Figure 4:
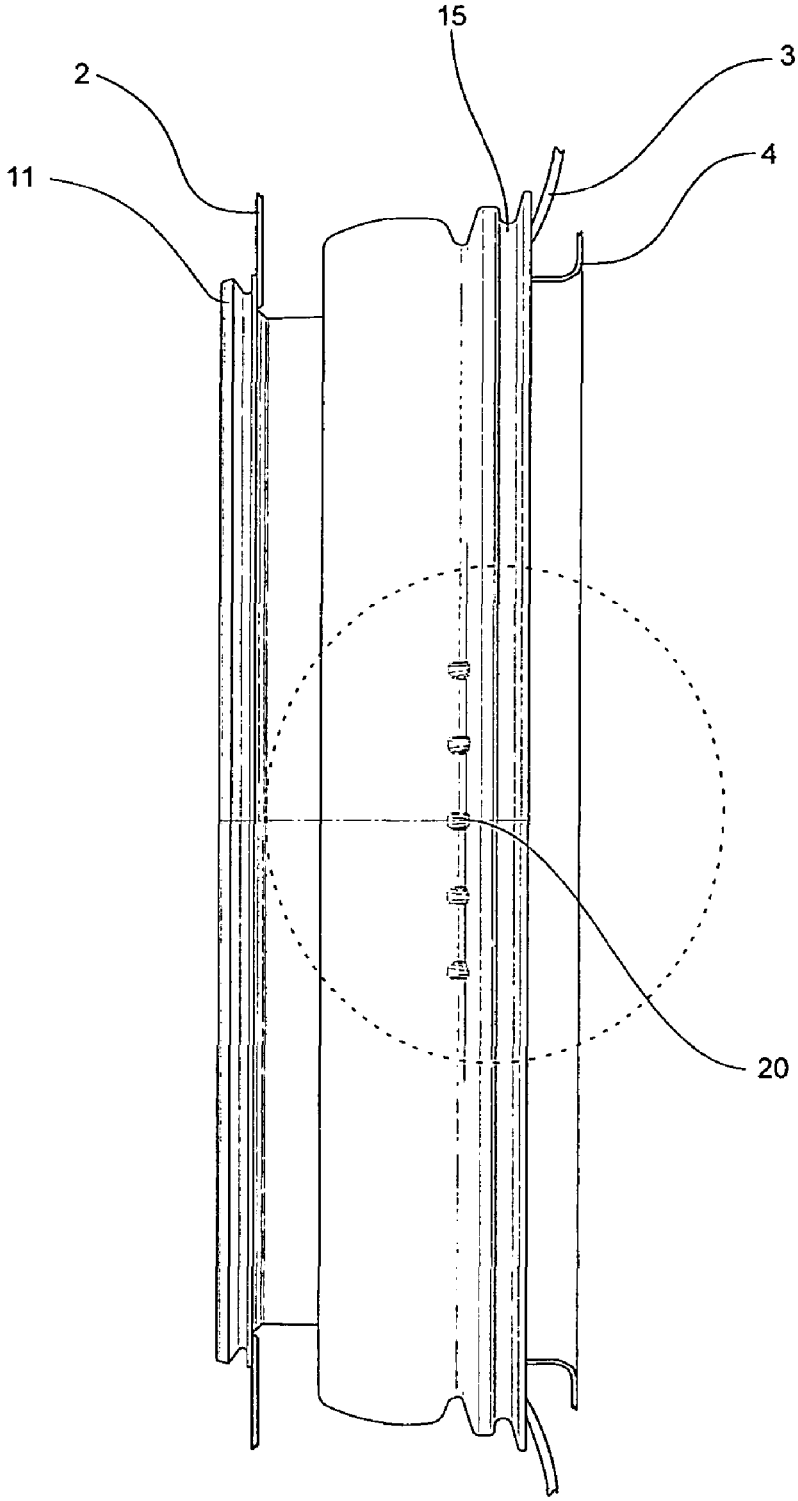
FIG. 4 is an enlarged view of part C in FIG. 1.

Also shown in FIG. 2, preferably a protrusion having a bent end 18 towards an inside of the drum 4 extends inwardly from said groove 17 at the upper position above said axis 5. Said bent end 18 functions as a kicker to return the laundry back into the drum 4 when the laundry is lifted by the rotational force of the drum 4 and becomes wedged between the gasket 1 and the drum 4 in a washing process. Furthermore at a lower position opposite to said upper position, a plurality of water leakages 19 are disposed in said rear flange 15 to provide a plurality of drain holes for the residual water flowing back into the tub 3. To additionally increase the rigidity of the gasket, a plurality of ribs 20 are further defined on a perimeter of said first section 13 at an appropriate distance away from said front flange 11 as shown in FIG. 4.

To absorb the greater vibration caused by the drum and the tub assembly in a normal operation process at the lateral position with respect to the rotational axis, the gasket as described above has a greater outwardly curved contour at the lateral position to correspondingly provide a greater capacity to compensate the vibration transmitted by the drum and the tub assembly. As a result the different curved contour of the gasket decreases the damage bringing to the frame and the gasket itself to some extent.

Although one preferred embodiment of the present invention has been shown and described, it will be appreciated by those skilled in the art that changes may be made in this embodiment without departing from the principles of the invention, the scope of which is defined in the appended claims.

What is claimed is:

1. A gasket to be coupled between a frame of a washing machine having a drum and a tub disposed inside the frame, said drum defining a substantially horizontal axis of rotation installed within said tub, the gasket comprising:

a front flange adapted to be connected to the frame;

a rear flange adapted to be connected to the tub and to be engaged with the drum;

a first section connected to the front flange; and a second section connecting the first section and the rear flange;

wherein a lower position of the gasket is vertically below the substantially horizontal axis of rotation, an upper position of the gasket is vertically above the substantially horizontal axis of rotation and opposite the lower position, and a lateral position of the gasket is disposed to each horizontal side of the substantially horizontal axis of rotation, wherein the second section has a contour that is a substantially flat contour at the lower position, wherein the contour of the second section increasingly curves radially outwardly from the substantially horizontal axis of rotation along a portion of the gasket extending from the lower position to the lateral position, and wherein the contour of the second section decreasingly curves radially outwardly from the substantially horizontal axis of rotation along a portion of the gasket extending from the lateral position to the upper position.

2. The gasket according to claim 1, wherein a first curved brim extends outwardly from the front flange to engage with a first curved rim of the frame.

3. The gasket according to claim 2, wherein a second curved brim extends outwardly from the rear flange to engage with a second curved rim of the tub and a groove extends inwardly from the rear flange to engage with a bent edge of the drum.

4. The gasket according to claim 3, wherein at an apex position above the substantially horizontal axis of rotation at least one protrusion having a bent end towards an inside of the drum extends inwardly from the groove.

5. The gasket according to claim 2 further including a plurality of ribs disposed on a perimeter of the first section at a position near to the front flange.

6. The gasket according to claim 1 further including a plurality of water leakages disposed in the rear flange at the lower position.

7. The gasket of claim 1, wherein the first section is a substantially U-shaped section.

8. The gasket of claim 7, wherein the substantially flat contour of the second section is substantially parallel to the substantially horizontal axis of rotation.

9. A gasket to be coupled between a frame of a washing machine having a drum and a tub disposed inside the frame, said drum defining a substantially horizontal axis of rotation installed within said tub, the gasket comprising:

a front flange adapted to be connected to the frame;

a rear flange adapted to be connected to the tub and to be engaged with the drum;

a first section connected to the front flange; and a second section connecting the first section and the rear flange;

wherein the second section includes a lower portion that is located vertically below the substantially horizontal axis of rotation, an upper portion that is located vertically above the substantially horizontal axis of rotation and opposite the lower portion, and a lateral portion that is located to each horizontal side of the substantially horizontal axis of rotation, wherein the lower portion of the second section has a first contour that is a substantially flat contour and is substantially parallel to the substantially horizontal axis of rotation, wherein the lateral portion of the second section has a second contour that is a curved contour that curves radially outwardly from the substantially horizontal axis of rotation by a first distance, wherein the upper portion of the second section has a third contour that is a curved contour that curves radially outwardly from the substantially horizontal axis of rotation by a second distance, and wherein the first distance is greater than the second distance.

10. The gasket of claim 9, wherein a distance that the curved contour of the second section curves radially outwardly from the substantially horizontal axis of rotation increases with an increase in a circumferential distance along a portion of the gasket away from the lower portion and toward the lateral portion, and wherein the distance that the curved contour of the second section curves radially outwardly from the substantially horizontal axis of rotation decreases with an increase in a circumferential distance along a portion of the gasket away from the lateral portion and toward the upper portion.

11. The gasket of claim 9, wherein the first section is a substantially U-shaped section.

12. A washing machine comprising:

a frame;

a tub disposed inside the frame;

a drum defining a substantially horizontal axis of rotation installed within the tub; and a gasket including:

a front flange connected to the frame and a rear flange connected to the tub and engaged with the drum;

a first section connected to the front flange and a second section connecting the first section and the rear flange;

wherein a lower position of the gasket is vertically below the substantially horizontal axis of rotation, an upper position of the gasket is vertically above the substantially horizontal axis of rotation and opposite the lower position, and a lateral position of the gasket is disposed to each horizontal side of the substantially horizontal axis of rotation, wherein the second section has a contour that is a substantially flat contour at the lower position, wherein the contour of the second section increasingly curves radially outwardly from the substantially horizontal axis of rotation along a portion of the gasket extending from the lower position to the lateral position, and wherein the contour of the second section decreasingly curves radially outwardly from the substantially horizontal axis of rotation along a portion of the gasket extending from the lateral position to the upper position.

13. The washing machine of claim 12, wherein the first section is a substantially U-shaped section.

14. The washing machine of claim 13, wherein the substantially flat contour of the second section is substantially parallel to the substantially horizontal axis of rotation.

* * * * *